US009168645B2

(12) United States Patent
Wassenhoven et al.

(10) Patent No.: US 9,168,645 B2
(45) Date of Patent: Oct. 27, 2015

(54) HAND-OPERATED PRESSING TOOL

(75) Inventors: Hedwig Wassenhoven, Monchengladbach (DE); Jennifer Hausmann, Wuppertal (DE)

(73) Assignee: Novopress GmbH Pressen Und Presswerkzeuge & Co. KG, Neuss (DE)

( * ) Notice: Subject to any disclaimer, the term of this patent is extended or adjusted under 35 U.S.C. 154(b) by 255 days.

(21) Appl. No.: 13/881,878

(22) PCT Filed: Oct. 26, 2011

(86) PCT No.: PCT/EP2011/068726
§ 371 (c)(1),
(2), (4) Date: Apr. 26, 2013

(87) PCT Pub. No.: WO2012/055902
PCT Pub. Date: May 3, 2012

(65) Prior Publication Data

US 2013/0239380 A1 Sep. 19, 2013

(30) Foreign Application Priority Data

Oct. 29, 2010 (DE) ..... 20 2010 014 879 U

(51) Int. Cl.
*B25B 27/10* (2006.01)
*B25B 27/14* (2006.01)
*B25F 5/02* (2006.01)
(Continued)

(52) U.S. Cl.
CPC ..... *B25B 27/10* (2013.01); *B25B 27/026* (2013.01); *B25B 27/146* (2013.01); *B25F 5/005* (2013.01); *B25F 5/02* (2013.01); *Y10T 29/5367* (2015.01); *Y10T 29/53909* (2015.01)

(58) Field of Classification Search
CPC ..... B25F 5/00; B25F 5/02; B23Q 17/00; B23Q 5/00
USPC ..... 29/235, 237, 238, 244, 252; 362/119, 362/120, 363, 89; 81/489, 9.3
See application file for complete search history.

(56) References Cited

U.S. PATENT DOCUMENTS 3,696,425 A * 10/1972 Perkins ..... 342/407
4,689,534 A * 8/1987 Gerber et al. ..... 388/809
5,068,652 A * 11/1991 Kobayashi ..... 340/815.43
(Continued)

FOREIGN PATENT DOCUMENTS

DE 102008041511 A1 3/2010
WO 03057395 A1 7/2003

OTHER PUBLICATIONS

International Search Report dated Jan. 25, 2013 for PCT application No. PCT/EP2011/068726.
(Continued)

*Primary Examiner* — Lee D Wilson
*Assistant Examiner* — Tyrone V Hall, Jr.
(74) *Attorney, Agent, or Firm* — Ohlandt, Greeley, Ruggiero & Perle, LLP

(57) ABSTRACT

A hand-operated pressing tool, which is suitable in particular for producing pipe connections, for pressing cable lugs, and/or for actuating cutting jaws, comprises a drive device arranged in a housing. The drive device is connected to an energy source. Furthermore, a start button, a display device, and a diagnostic connector are provided. The start button as well as the display device are arranged under a transparent housing cover. Preferably, the housing cover can be opened in order to reach the diagnostic connector.

13 Claims, 3 Drawing Sheets

(51) Int. Cl.
*B25B 27/02* (2006.01)
*B25F 5/00* (2006.01)

(56) References Cited

U.S. PATENT DOCUMENTS 5,473,519 A * 12/1995 McCallops et al. ..... 362/120
6,536,536 B1 * 3/2003 Gass et al. ..... 173/2
7,682,035 B2 * 3/2010 Wuensch et al. ..... 362/119
2005/0152131 A1 * 7/2005 Shirane ..... 362/119
2009/0229842 A1 * 9/2009 Gray et al. ..... 173/20
2011/0140707 A1 * 6/2011 Boker et al. ..... 324/511

OTHER PUBLICATIONS

Written Opinion dated Jan. 25, 2013 for PCT application No. PCT/EP2011/068726.
International Preliminary Report on Patentability dated May 21, 2013 for PCT application No. PCT/EP2011/068726.

* cited by examiner

HAND-OPERATED PRESSING TOOL

BACKGROUND

1. Field of the Disclosure

The disclosure relates to a hand-operated pressing tool which is suitable in particular for establishing pipe connections, pressing cable lugs, actuating cutting jaws, and the like.

2. Discussion of the Background Art

Hand-operated pressing tools of the above type comprise a drive device arranged in a housing. Such a drive device is, e.g., a hydraulic drive device whose hydraulic pump is driven by an electric motor. The pressing tool further comprises a tool holder which serves, e.g., for taking up press jaws, cutting jaws and the like. With the aid of the drive device, the tool will then be operated. Such hand-operated tools comprise an energy source, wherein the energy supply takes place via a cable or an integrated energy source such as a rechargeable battery. To actuate the tools, i.e., for instance, to start the pressing process by which e.g. tube connections are pressed, there is further provided a start button. The latter is normally designed as an elastically or resiliently supported start button and not as a switch because a pressing process will be triggered by actuating the start button and, after finishing the pressing process, will be terminated preferably automatically. Normally, herein, the pressing process will be checked by indirect or direct measurement of the pressing force. Further, the housing often has a display device connected to it.

The display device usually comprises LED lights in different colors indicating e.g. the quality of the press connection which is indicative of malfunctions, the necessity of maintenance, or also the charging level of the rechargeable battery. Further, hand-operated pressing tools usually comprise a control device, such as e.g. a control board, for controlling the pressing process. The control device is used for controlling e.g. the electric motor and the like. Further, the control device can be employed for receiving and processing measurement data from pressure or displacement sensors, as well as for receiving a power or voltage intake of the electric motor. These data can be used for control as well as for checking the quality of the pressing and cutting process. Further still, for diagnosis, hand-operated pressing tools usually comprise a diagnostic connector. The control device, the start button, the display device and also the diagnostic connector have to be wired within the housing. The provision of cables or corresponding electric contacts is failure-prone and increases the manufacturing costs of the press tool.

It is an object of the disclosure to provide an improved hand-operated pressing tool wherein, particularly, the manufacturing costs are reduced while maintaining a high reliability.

SUMMARY

The hand-operated pressing tool according to the disclosure, which is suited particularly for producing pipe connections or cable lug connections by pressing, but also for operating cutting jaws by forces generated in particular hydraulically, comprises a housing with a drive device arranged therein. The drive device preferably comprises a hydraulic device and an electric motor driving a hydraulic pump.

Further, the drive device is connected to an energy source such as e.g. a rechargeable battery. According to the disclosure, a housing cover is provided, wherein, under said housing cover, there are arranged a start button as well as a display device serving e.g. for indicating an operational state, the charging level of the rechargeable battery, a malfunction, the quality of the press connection, etc. According to a particularly preferred embodiment, the housing cover is transparent at least in the area of the display device, with the display device preferably being formed at least partially as a light indicator and, in so far, comprising e.g. a display monitor or LEDs. Thus, the light indicators are visible through the transparent housing cover. According to a preferred embodiment, the perceptibility or visibility of the light indicator is improved in that the housing cover comprises light-conducting elements allowing for light conduction from the light indicators to the outside of the housing cover. In such an arrangement, the light-conducting elements can be formed particularly in one piece with the housing cover which, according to a preferred embodiment, is made of plastic.

According to a further preferred embodiment of the disclosure, a control device is provided which particularly is formed as a control board and is likewise arranged under the housing cover. Due to the arrangement of the control device under the housing cover, as provided by the disclosure, it is possible to connect the start button and the display device directly to the control device. Thus, if the control device is designed as a control board, the start button and/or the display device can be arranged immediately on the control board. This will avoid the necessity to provide electrical connection cables between the control device and the start button as well as between the control device and the light indicators. According to a further particularly preferred embodiment of the disclosure, the housing cover serves for actuating the start button. For this purpose, the housing cover or at least a part of the housing cover is held resiliently on the housing.

According to a preferred embodiment, the above feature can be realized by a swivel projection on the housing cover. The swivel projection comprises e.g. two projections such as, e.g., swivel feet, connected—particularly in one piece—with the housing cover. About these swivel projections, the housing cover can then be swiveled, while already a slight swiveling will be sufficient because, in the area of the start button, the housing cover needs to be movable by just a few millimeters for actuating the start button. Since the start button is provided particularly as a resilient button which after actuation will automatically return to its initial position, it is preferred that the housing cover is held on the housing in a resilient manner. This can be realized in that, in addition to the provision of the swivel projections, a spring element such as e.g. a coil spring is arranged under the housing cover so that the housing cover will always be pressed back into an initial position in which the start button is not pressed. The spring element can also be integrated into the start button. Since the housing cover is preferably made of a plastic material, it is preferred, instead of using a coil spring or the like, to provide a spring projection on the housing cover, said spring projection being particularly formed in one piece with the housing cover. The spring projection, which, e.g., likewise comprises two spring feet and, respectively, elastic spring arms, will always press the housing cover—unless the latter is pressed by the user in the direction toward the pressing tool—back into an initial position in which the start button is not actuated. In this arrangement, the housing cover can be fixed in its initial position by a holding element. Herein, said holding element can be a projection, likewise connected directly to the housing cover, which extends into a recess, thus allowing the housing cover to be folded into the fully opened position or to be removed only when this projection has been pulled or pressed out of the recess. Thus, the projection is effective as a sort of locking connection to a housing wall.

According to a further preferred embodiment, the housing cover is partially—in particular with the region where the swivel projection and/or the spring projection is located—arranged in a housing bin. The housing cover is held in the housing bin preferably in a displaceable manner. This has the advantage that, by being pulled out from the housing bin, the housing cover can be completely removed or be folded into an open position. Thereby, the control device, particularly the control board, are accessible in an easy manner. Advantageously, thereby, e.g. damaged start buttons or illuminants can be replaced in a simple manner. Preferably, the control device additionally has a diagnostic connector connected to it, wherein the latter, in case a control board is provided in the control device, is arranged directly on the control board. Thus, by folding open or removing the housing cover in a corresponding manner, the diagnostic connector will be directly accessible.

BRIEF DESCRIPTION OF THE DRAWINGS

The disclosure will be explained in greater detail hereunder by way of a preferred embodiment with reference to the accompanying drawings.

In the drawings, the following is shown.

DETAILED DESCRIPTION OF THE PREFERRED EMBODIMENT

Figure 1:
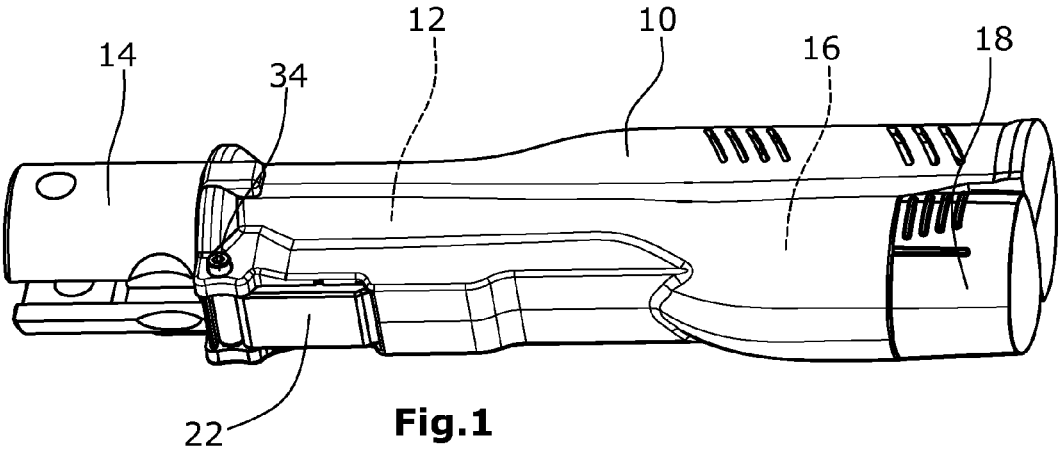
FIG. 1 is a schematic perspective view of a hand-operated pressing tool.

A hand-operated pressing tool comprises, internally of a housing 10, a hydraulic device 12 serving for transmission of a pressing force onto tools, not shown, such as e.g. press jaws.

The tools are arranged in a tool holder 14. A hydraulic pump of the hydraulic device is driven by an electric motor 16. In the illustrated embodiment, a rechargeable battery 18 is provided for energy supply. If the pressing tool is connected e.g. to press jaws, the triggering of the pressing process will be performed by actuating a start button 20 (FIG. 2) arranged under a transparent housing cover 22. In the illustrated embodiment, the start button 20 is arranged directly on a control board 24 forming the control device. The start button 20 in the illustrated embodiment is not a switch such as e.g. a toggle switch but a resiliently supported key. Thus, by pressing the start button 20 once, there will be triggered e.g. a complete pressing process. The pressing process will be stopped, preferably automatically, when the pressing process has been concluded, when the start button is released, or if a disturbance occurs. To make it possible to actuate the start button in a simple manner with the aid of the housing cover, the housing cover 22 could be connected to the housing 10 e.g. via a joint or in an elastically resilient manner. In the illustrated embodiment, the housing cover 22 is provided, for this purpose, with a swivel projection comprising two swivel feet 26. Relative to an upper side of the start button 20, said swivel feet 26 extend downward and, in the illustrated embodiment, are of a curved shape and, particularly, are guided in mutually opposite rails 30.

Figure 2:
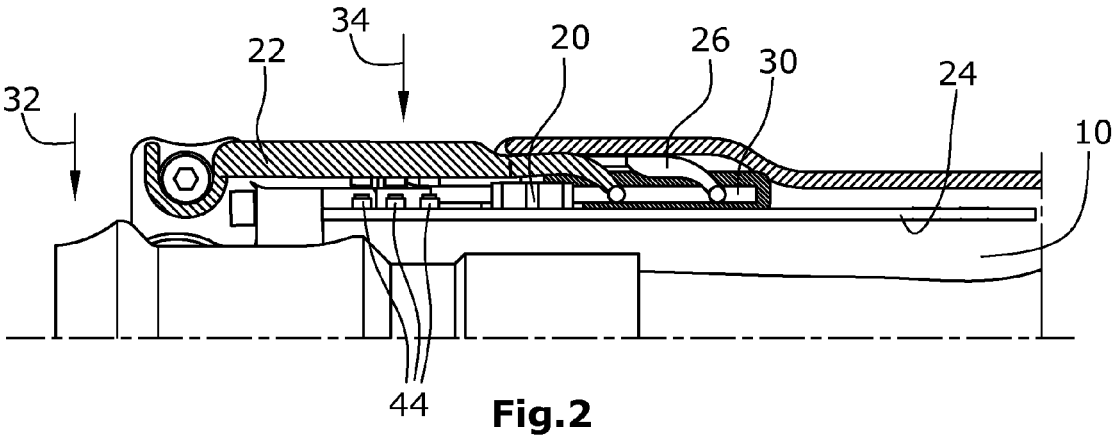
FIGS. 2-5 are schematic partially sectional views of the pressing tool in the area of the housing cover, and FIG. 6 a schematic perspective view of the area of the housing cover.
Figure 3:
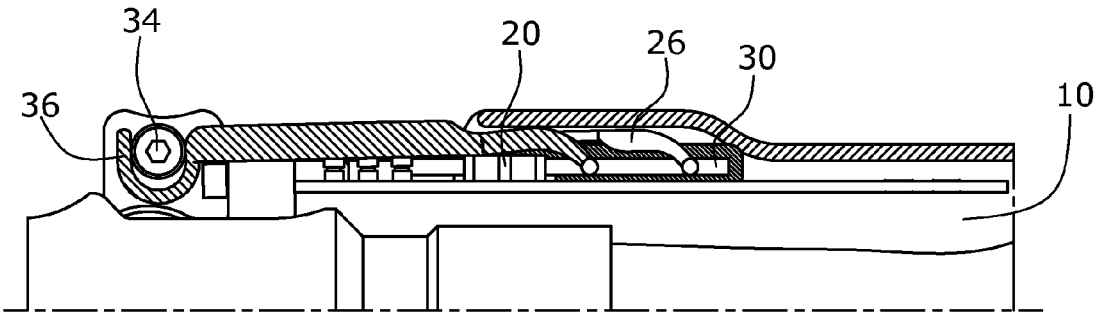

The left end of housing cover 22 in FIG. 2, arranged opposite to swivel projection 26, is not connected tightly to housing 10 but, at least within a predefined area, is displaceable in the direction indicated by arrow 32 (FIG. 2) toward the housing 10. Thus, application of a pressure force represented by an arrow 32 will result in a swiveling movement about the swivel feet 26 into the position shown in FIG. 3, in which a distance is generated between a fixing element 34 with a screw, and a cross-sectionally U-shaped projection 36 of housing cover 22. Thereby, the start button 20 will be actuated.

According to a preferred embodiment, for safeguarding a resilient return movement of the housing cover 22 into the base position (FIG. 2), housing cover 22 is further provided with a spring projection which, in the illustrated embodiment, comprises two spring feet or spring arms 38 integrally connected to the housing cover 22. The two spring feet 38 are arranged laterally adjacent to an intermediate portion 40 of housing cover 22, wherein said intermediate portion 40 is on the one hand connected to the swivel projections 26 and, on the other hand, to a main portion 42. Due to the elastic design of the spring feet 38, cease of the pressure force 32 will cause the housing cover 22 to resiliently return, or be pressed back, to its base position (FIG. 2).

In the illustrated preferred embodiment, the control board 24 has light indicators such as e.g. LEDs 44 directly connected to it. In the operating state of the device, said light indicators 44 can indicate a charge level of the rechargeable battery and the like. In the closed state of the cover (FIGS. 2 and 3), the LEDs 44 are arranged under light-conducting elements 46. The light-conducting elements, which particularly are provided as cylindrical projections, are preferably integrally connected to the housing cover 22. The provision of the light-conducting elements 46 allows for clear visibility of the LEDs in the closed state of housing cover 22.

Figure 4:
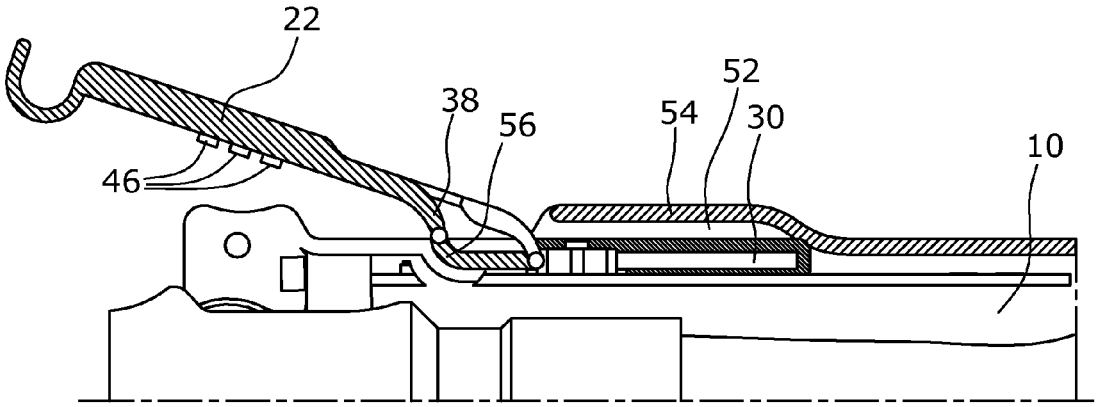
Figure 5:
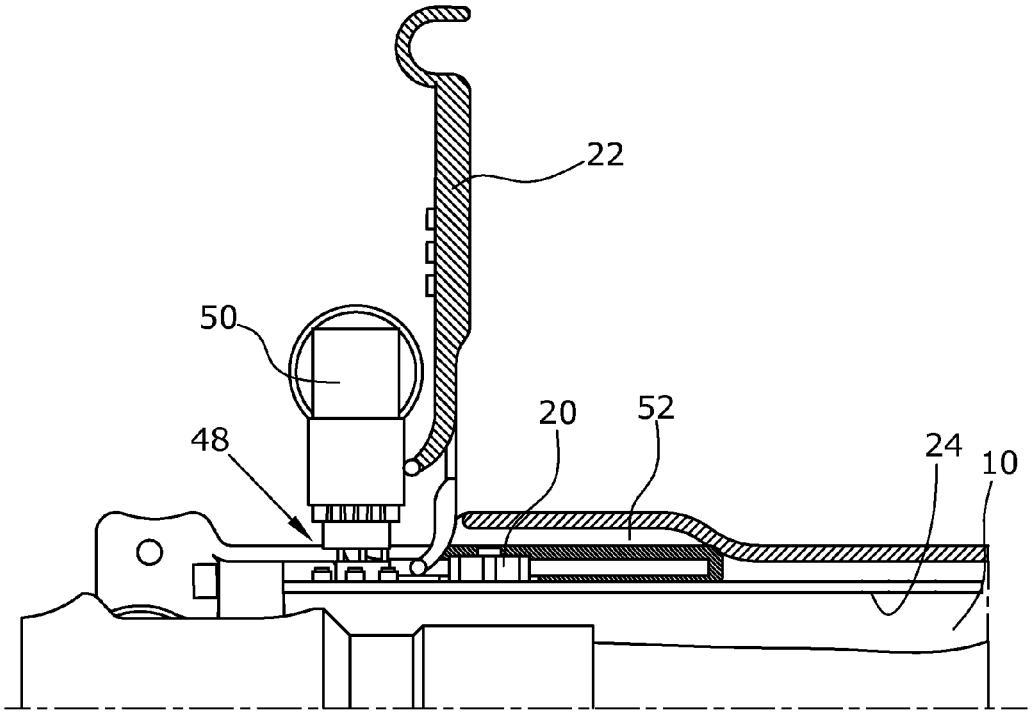
Figure 6:
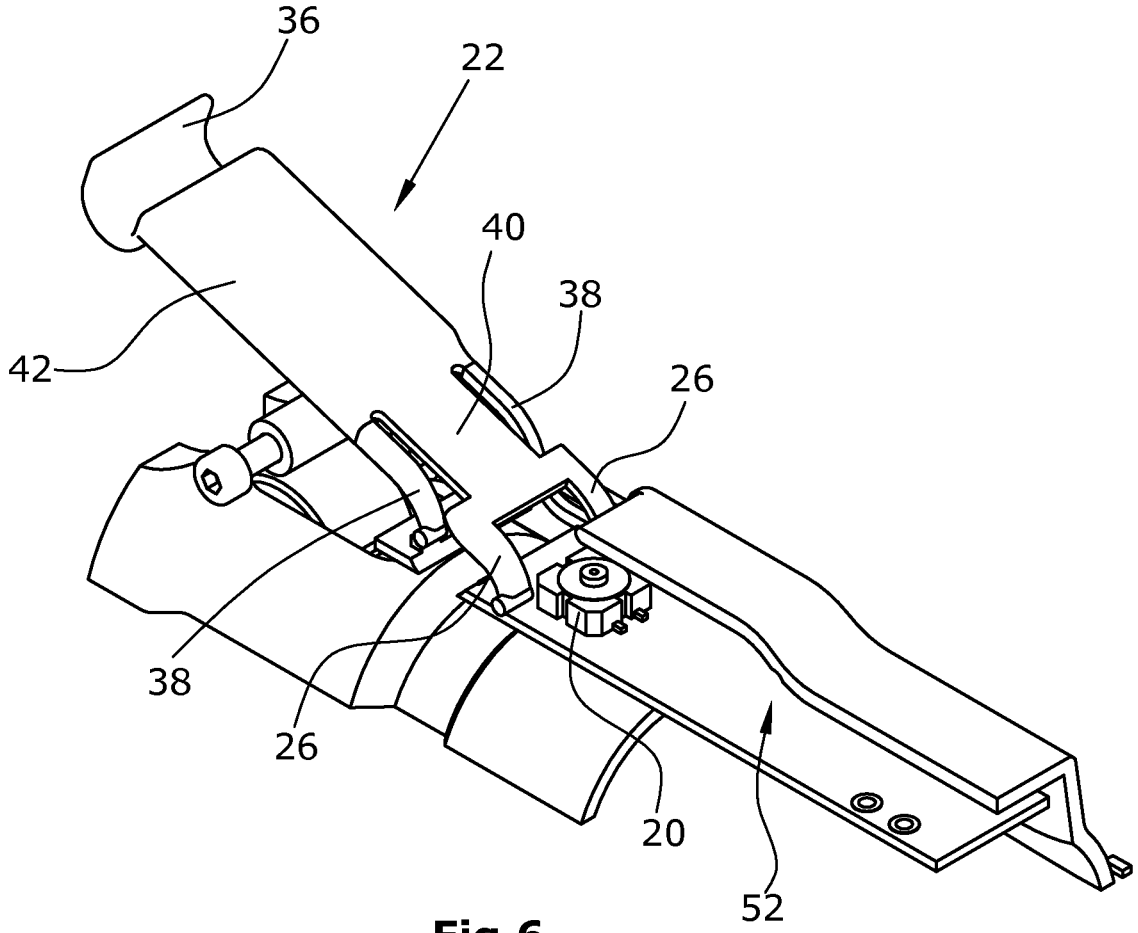

In the particularly preferred design of the inventive housing cover, the latter is further openable to the effect that a diagnostic connector 48 (FIG. 5) provided directly on the control board 24 is accessible in order to connect a diagnostic device 50 to the control board 24. First, for this purpose, the fixing element 34 formed as a screw will be released. Then, it will be possible to pull the housing cover 22 out from a housing bin 52 (FIG. 4). Housing bin 52 is formed by an outer housing wall 54 of housing 10, wherein, in the dosed state of the housing cover 22 (FIGS. 2 and 3), the housing wall 54 partially covers the latter.

When the housing cover 22 is being pulled out toward the left in FIG. 4, the swivel feet 26 as well as the spring feet 38 are sliding in the rail 30. On one end 56 of rail 30, the spring projections 38 can be guided out of the rail 30. Thus, the housing cover can be swiveled open into the position shown in FIG. 5.

What is claimed is:

1. A hand-operated pressing tool, in particular for producing pipe connections, for pressing cable lugs, and/or for actuating cutting jaws, the tool comprising a drive device disposed in a housing, an energy source connected to the drive device, a start button disposed under a housing cover, wherein the start button starts and stops operation of the pressing tool, and a display device disposed under the housing cover.

2. The hand-operated pressing tool according to claim 1, wherein the housing cover is transparent at least in a portion of the region of the display device, and wherein the display device comprises light indicators.

3. The hand-operated pressing tool according to claim 1, further comprising a control device comprised of a control board, wherein the control device is disposed under the housing cover.

4. The hand-operated pressing tool according to claim 3, wherein the start button, the display device or both connected to the control device by being disposed directly on the control board.

5. The hand-operated pressing tool according to claim 2, wherein the housing cover comprises light-conducting elements disposed above the light indicators.

6. The hand-operated pressing tool according to claim 1, wherein the housing cover is resiliently held on the housing for actuating the start button.

7. The hand-operated pressing tool according to claim 1, wherein the housing cover comprises a swivel projection for allowing a swivel movement for actuating the start button.

8. The hand-operated pressing tool according to claim 7, wherein the housing cover comprises a spring projection for pressing back the housing cover after actuation of the start button.

9. The hand-operated pressing tool according to claim 8, wherein the swivel projection and the spring projection of the housing cover are partially disposed in a housing bin.

10. The hand-operated pressing tool according to claim 9, wherein said housing bin is formed by a linear space between a housing wall and the control board.

11. The hand-operated pressing tool according to claim 9, wherein the housing cover is displaceably disposed in the housing bin.

12. The hand-operated pressing tool according to claim 11, wherein the housing cover is removable from the housing or is foldable into an open position angled away from the housing by a movement comprising by a slidable movement of the swivel projection and the spring projection in relation to the housing bin.

13. The hand-operated pressing tool according to claim 12, wherein the control device comprises a diagnostic connector which is accessible by removing the housing cover or by folding the housing cover into the open position.

* * * * *